United States Patent [19]

Cohen

[11] 3,996,158

[45] Dec. 7, 1976

[54] PUMICITE FILTER AID

[76] Inventor: Marvin D. Cohen, 9251 Burdine, No. 297, Houston, Tex. 77016

[22] Filed: Sept. 23, 1974

[21] Appl. No.: 508,164

[52] U.S. Cl. ..... 252/378 R; 252/459; 8/142; 210/510

[51] Int. Cl.[2] ..... C04B 31/22; C04B 31/26; B01J 29/10

[58] Field of Search ..... 252/378 R, 378 P, 457, 252/459; 210/510; 8/142

[56] References Cited

UNITED STATES PATENTS

| | | | |
|---|---|---|---|
| 3,203,754 | 8/1965 | Young et al. | 8/142 |
| 3,233,740 | 2/1966 | Vander Linden et al. | 252/378 P |
| 3,335,869 | 8/1967 | Hedges | 252/378 R |

*Primary Examiner*—Carl F. Dees
*Attorney, Agent, or Firm*—Bernard A. Reiter

[57] ABSTRACT

This invention relates to the use of a limited specie of glassy rhyolite, specifically pumicite as a filter aid for the cleaning of solvent in the drycleaning industry. The invention is particularly directed to the new and unexpected results accruing from the use of pumicite for accomplishing extremely low, non-volatile levels in the solvent and for also removing objectionable fatty acids and odor from the solvent while simultaneously making its distillation unnecessary and removing sufficient moisture to give clothes a softer feel, and fewer wrinkles.

10 Claims, No Drawings

PUMICITE FILTER AID

BACKGROUND OF THE INVENTION

This invention relates to an improved filter aid material. More particularly, this invention relates to the composition and preparation of an improved filter aid comprised of expanded comminuted pumicite particulate. These particulates are to be used for clarifying and dehydrating the soiled solvent used in drycleaning operations.

Heretofore, the solvent used in drycleaning operations has been clarified and dehydrated by various means such as processes of filtration, the use of precipitation by various chemical reagents, or diassociation. Various experimental tests have shown, however, that in practically no case is the effluent perfectly free of moisture and foreign matter. Thus, the "washing" of the solvent results in only a partially clean solvent and, hence, subsequently there may be only a less than optimal drycleaning accomplished because the solvent itself is not free of foreign matter. Also in the past, various experiments and practices have endeavored to use centrifugal separators in order to separate suspended impurities and moisture. It was found, however, that a gelatinous residue would remain, this being formed by the moisture in the goods being cleaned emulsifying with a percentage of the soaps and oils liberated in numerous cases with the soap used in drycleaning. The residue would hold finely divided solids matter in colloidal state and removal of such residue by mechanical means was found to be substantially impossible.

Other improvements in the process of "washing" the solvent used in drycleaning operations has included the use of diatomaceous earths and compositions of diatomaceous earths which are constructed to filter the cleaning solvent. These compositions commonly are known to have various adsorbents prepared in conjunction with the diatomaceous earths and commonly include alumina, metal silicates, ground or fiberous asbestos, metal stearaets, sawdust, cellulose powder, starch and/or various powdered synthetic polymers.

In more recent times, commercial filter aids have been manufactured from particulates of naturally occuring glass of igneous origin that will expand when heated to yield a light, cellular particle. The heated and expanded form of this particulate is commonly known in the trade as "perlite". In strict geological usage, this term is restricted to a single variety or specie of volcanic glass. Perlite usually is brittle and friable. It rarely has a silica content greater than 70% and a combined water content is generally present in the range of 2 to 5%. Technically, acid volcanic glasses containing less combined water than perlite are classed as obsidians, and those containing more combined water are classed as pitchstone.

The manufacture of perlitic particles requires their introduction into a flame so as to cause expansion under a controlled temperature in the range of 1600° F., the subsequent softening of the glass being coincidental with the volatilization and release of the combined water causing the particles to quickly expand or puff up to an aggregate many times their original volume. However, dependent upon it's origin, the perlite minerals differ markedly in the time and temperature necessary for expansion, the controlled temperatures varying generally between 1400° and 1900° F. Likewise, the relative chemical constituancy of naturally occuring perlite is extremely variable with a wide range of temperatures necessary to accomplish expansion of the particulate. Due to the inconsistant and variable range of chemical composition in naturally occuring perlite, the ultimate particle that is produced is very inconsistant insofar as it's reliability for the purpose of solvent cleaning is concerned. It has been found, for example, that perlite, though being inconsistently satisfactory as a filter, that the clarity of the filtrate is inferior to the clarity of the filtrate obtained when other types of filter aids are used. Moreover, perlite filter products produced to date have been characterized by their inability to function as high flow rate filter aids. As a result, it is the common consensus that they have generally been commercially rejected in the drycleaning industry as an effective and reliable filter aid.

DESCRIPTION OF THE INVENTION

Pumicite Filter Aids

This invention pertains to the discovery and utilization of pumicite, a specie of rhyolite, as a compound additive for use in the drycleaning trade for "washing" the cleaning solvent.

In the drycleaning trade, the term "non-volatile matter" commonly refers to perspiration, salt, oil and grease and other dirt which is normally removed from the garments that are cleaned. Excessive non-volatile matter in the cleaning solvent occurs after it is continuously used. When this happens the non-volatile component in the solvent becomes a serious problem because it leads to longer drying time, odor in the garments and swale on some types of materials. Measuring and limiting the non-volatile in the cleaning solvent leads to satisfactory cleaning. It therefore becomes necessary to control the non-volatile residue in the cleaning solvent and although this has been attempted before, such as through the utilization of various filter aids, including the aforementioned perlite filter aids, satisfactory and commercially acceptable filter aids for reliably limiting the non-volatile matter in cleaning solvents has not been accomplished.

The present invention is directed to the use of a specie of volcanic ash for the purpose of cleaning the solvent. This volcanic ash, broadly termed rhyolite constitutes a volcanic, mostly effusive, glass like equivalent of granite. The glassy rhyolites include obsidian, pitchstone and pumice (or pumicite). Through microscopic examination it is shown that pumices are actually ash flows and thus better designated as tuffs. These ash flows or tuffs are characterized by a crystalline pattern which is generally thread like or fiberous in shape and are further indicated by thin partitions between the vesicles. Rhyolite and trachyte types of pumices are white and generally have a specific gravity of the glass in the range of 2.3 to 2.4. The crystalline shape of pumicite may be contrasted with perlite, for example, which is teardropped or concentrically onion shaped in form.

The rhydites are known from all parts of the earth. Obsidian is well developed in Montana and the general locale. Pitchstone, of particular interest as a rock glass containing several percent of combined water, is found in Australia and other localities including Scotland. Pumicite, a frozen emulsion of air and lava of rhyolitic composition occurs in various areas of North America.

Small crystals of various minerals occur in many pumices; the most common are feldspar, augite, hornblend, and zircon. The cavities of pumices are generally elongate or tubular, as indicated above, this being due to their origination from a lava flow of constantly solidifying character. The chemical composition of rhyolite and trachyte pumices generally includes about 75% silica. For purposes of the invention described herein, however, it is desirable to use pumices containing silica content in the range of 80% or more. Specifically, expanded pumicite, which is described hereinafter, constitutes a volcanic dust comprised of a silicate rather than a silica. When expanded, the pumicite changes from it's flat irregular particles or shards to countless tiny glass-sealed hollow spheres or air cells increasing in volume from ten to fifteen times it's original size. The preferred pumicite composition includes silicon dioxide ($SiO_2$) in the range of 80% or more, iron oxide ($Fe_2O_3$) in the range of 2% and trace quantities of sulfur trioxide ($SO_3$) and magnesium oxide ($M_gO$) of about 3%. Moisture content comprises about 3% maximum. The physical form of pumicite is an extremely fine white powder and is chemically inert. It's thermal conductivity (K value) is less than .3 BTU per hour per square foot per degree Fahrenheit per in. (75° F. mean). It has a water absorption characteristic in the range of 700 to 800 pounds per 100 pounds. Pumicite, which is expanded in accordance with the explanation set forth hereafter, has a density of from 4.8 to 6 pounds per cubic foot. The expanded material does not require grinding since it is in the size range of 325 mesh, while retaining the micro-spherical configuration of the particle. The extremely fine pulverulent of pumicite substantially exceeds other forms of rhyolites including obsidian and pitchstone. Its pulverulence substantially exceeds perlite also. This is the case because pumices, as mentioned above, are actually ash flows and, by contrast to the other rhyolites, such as, obsidian and pitchstone are better designated technically as "tuffs". These tuffs are frequently so light as to be present in the atmosphere as volcanic dust.

In preparing the pumicite filter aid of the invention, the raw material or pumicite, is received in sand like form having uniform consistency and of mesh size in the area of 10 to 30. This raw material is introduced into a screw type drier having an internal temperature in the range of 600° F. The raw pumicite material moves through the drier so as to extract substantially all moisture content. The dried pumicite is then removed to a bin or other storage facility or in the alternative may be directly conveyed to the expander tube or "popper" as it is more commonly known. Here there is provided a feed pipe into the expander tube. Adjacent to the feed pipe is generally provided a gas jet directed into the expander tube. The flame of the gas jet should generally be in the temperature range of 2700° F. The raw pumicite material is introduced into the feed pipe and passed over the flame on it's way into the expander tube. Softening of the glass occurs coincidental with volatilization. Exposure to the elevated temperature produces the release of combined water in the particulate and immediately produces an expansion or puffing of the particulate up to an aggregate that is many times the original volume. During the expanding operation there is a substantial loss in density and the forming of a glassy type surface on the tiny hollow spheres. The expanded or bloated pumicite has a density in the range of 6 pounds per cubic foot. The heated material is then subjected to a fast cooling by permitting it to fall through a cooler, gaseous atmosphere so that the particles do not agglomerate while hot and plastic. Generally, the pumicite is dropped through a vertically directed flame and gathered in a collection system. The expanded material does not require grinding since it is in the size range of 300 mesh, the spherical configuration of the particles being retained.

As a filter aid, the expanded pumices or tuffs of the invention are markedly superior when compared to other commonly known solvent filter aids. By comparison to perlite, for example, the expended pumicite is characterized by the following specific advantages:

1. It makes distillation of the solvent unnecessary.
2. It can be used effectively in petroleum solvent or in perchlorethylene.
3. In substantially all experimental cases, it has increased the flow rate and reduced filter pressure more effectively than other filter aids.
4. It does not remove the soap charge from the cleaning solvent.
5. It removes rancid odor from solvent.
6. Expanded pumicite is found to remove objectionable fatty acids.
7. Expanded pumicite is further found to remove sufficient moisture to give clothes a softer feel, less wrinkles. Clothes are easier to press.
8. Expanded pumicite has been found, in experimental and actual use to reduce the NVR (Non-Volatile Ratio) to a safe operating level, well below the 1½% recommended, when properly used. More particularly, there is found to exist an oil absorption characteristic in the range of 500 pounds per one hundred pounds.

It should be understood that variations and modifications to the specifics of the invention set forth may be made without departing from the spirit hereof. It is also to be noted that the scope of the invention is not to be interpreted as limited to the specific embodiments disclosed herein but only in accordance with the appended claims, when read in light of the foregoing description.

That which is claimed and desired to be secured by United States Letters Patent is:

1. An improved filter aid for the washing of drycleaning solvent comprising heat expanded pumicite particulates, said particulates being in the size range of three hundred mesh and having a silicon dioxide content in the range of eighty percent or more.

2. An aggregate for use in facilitating the washing of drycleaning solvent so as to maintain a low ratio of non-volatile matter therein and thereby improve the drycleaning process consisting of a rhyolitic, effusive volcanic dust of the pumicitic specie which has been expanded and exploded to produce a pulverulent in the range of three hundred mesh.

3. A pulverulent aggregate filter aid for facilitating the reduction of non-volatile matter in drycleaning solvent and for removing oil and water therefrom by deposition into the solvent stream comprising:

heat expanded rhyolite particulates of the pumicite specie, said particulates having a chemical composition that includes silicon dioxide in the amount of eighty percent or more and which have a water absorption capability in the range of eight hundred pounds per one hundred pounds.

4. The aggregate of claim 3 wherein the pumicite is a silicate.

5. The aggregate of claim 4 wherein the oil absorption characteristic is in the range of five hundred pounds per one hundred pounds.

6. The aggregate of claim 5 wherein the expanded material is in the size range of three hundred mesh.

7. A filter aid composed of heat expanded and popped pumicite mineral in which the chemical composition thereof consists of 80% to 84% $SiO_2$, 1.5 to 2.5% $Fe_2O_3$ and which has a density of 4 to 6 pounds per cubic foot and which has a water absorption capability of 800 times its weight and an oil absorption capability of 400 times its own weight.

8. An improved filter aid for the washing of dry cleaning solvent comprising heat expanded pumicite particulates, said particulates being in the size range of 300 mesh and having a silicon dioxide content in the range of eighty percent or more, the head expansion occurring upon exposure to an atmospheric temperature in the range of 2700° F.

9. An aggregate for use in facilitating the washing of dry cleaning solvent, so as to maintain a low ratio of non-volatile matter therein and thereby improve the dry cleaning process consisting of a rhyolitic effusive volcanic dust of the pumicitic specie which has been expanded and exploded to produce a pulverulent in the range of 300 mesh, said aggregate consisting of a silicon dioxide content in the range of eighty percent or more.

10. In an aggregate for facilitating the removal of contaminants such as oil and water from a cleaning fluid, comprising a heat expanded pumicitic particulate, said particulate being in the size range of 300 mesh and having a silicon dioxide content in the range of eighty percent, the oil absorption characteristic of the particulate being in the range of 500 pounds per 100 pounds.

* * * * *